United States Patent [19]

Delvaux et al.

[11] Patent Number: 4,976,884

[45] Date of Patent: Dec. 11, 1990

[54] HEAT RESISTANT COMPOSITION PROCESSABLE BY WET SPINNING

[75] Inventors: Pierre Delvaux, Bromptonville; Normand Lesmerises, Rock Forest, both of Canada

[73] Assignee: Ceram-Sna Inc., Sherbrooke, Canada

[21] Appl. No.: 409,066

[22] Filed: Sep. 19, 1989

[51] Int. Cl.[5] ..... E04B 1/76

[52] U.S. Cl. ..... 252/62; 162/153; 162/155

[58] Field of Search ..... 252/62; 162/3, 152, 162/153, 155

[56] References Cited

U.S. PATENT DOCUMENTS

| | | | |
|---|---|---|---|
| 3,224,927 | 12/1965 | Brown et al. | 162/155 |
| 3,682,667 | 8/1972 | Roberts et al. | 252/62 |
| 3,954,556 | 5/1976 | Jackson et al. | 252/62 |
| 4,274,881 | 6/1981 | Langton et al. | 106/98 |
| 4,277,596 | 7/1981 | Lalancette | 524/454 |
| 4,363,738 | 12/1982 | Kummermehr | 252/62 |
| 4,414,031 | 11/1983 | Studinka et al. | 428/36.4 |
| 4,430,157 | 2/1984 | Lalancette | 162/3 |
| 4,519,811 | 5/1985 | Lalancette et al. | 51/309 |
| 4,604,140 | 8/1986 | Lalancette et al. | 106/38.9 |
| 4,710,309 | 12/1987 | Miller | 252/62 |

FOREIGN PATENT DOCUMENTS

| | | |
|---|---|---|
| 47728 | 3/1982 | European Pat. Off. . |
| 57-160977 | 10/1982 | Japan . |
| 57-205380 | 12/1982 | Japan . |
| 58-020784 | 2/1983 | Japan . |

*Primary Examiner*—Paul Lieberman
*Assistant Examiner*—Christine A. Skane
*Attorney, Agent, or Firm*—Foley & Lardner, Schwartz, Jeffery, Schwaab, Mack, Blumenthal & Evans

[57] ABSTRACT

Disclosed is a heat-resistant composition particularly useful to produce heat-resistant boards or tubes, capable of resisting to a high temperature for a substantial period of time. The composition comprises from 70 to 90% by weight of a fibrous-like, synthetic forsterite obtained by calcination of chrysotile asbestos fibers at a temperature of from 650° C. to 1450° C., the synthetic forsterite having an MgO:SiO2 ratio lower than 1:1, a raw loose density of from 3 to 40 pcf, a thermal conductivity "k" factor of from 0.25 to 0.40 BTU. in/hr.°F.ft$^2$ and a fusion point of from 1600° C. to 1700° C. The composition also comprises an organic binder such as starch or latex, a mineral binder of the silicate type such as sodium or potassium silicate, or a mixture thereof. If desired, the composition may further comprise reinforcing fibers in such an amount as to give sufficient strength to the composition to make it operative depending on the intended use of the article produced therefrom. This composition can be used in particular to produce fire proofing boards.

7 Claims, No Drawings

HEAT RESISTANT COMPOSITION PROCESSABLE BY WET SPINNING

BACKGROUND OF THE INVENTION (a) Field of the Invention

The present invention relates to a new heatresistant composition particularly useful to produce heatresistant boards and tubes capable of resisting to high temperatures for substantial periods of time. The invention also relates to the boards and tubes obtained from such a composition by wet spinning.

(b) Brief Description of the Invention

U.S. Pat. application Ser. No. 246,198 filed on Nov. 8, 1988 in the name of the same Applicant, discloses and claims a fibrous-like synthetic forsterite product which is particularly useful as an insulating material. This product which is presently offered for sale under the trademark FRITMAG and will be called as such hereinafter, is obtained by subjecting chrysotile asbestos fibers of any commercial grade, having an MgO: SiO2 ratio lower than 1:1, to calcination at a temperature of from 650° C. to 1450° C.

FRITMAG has a raw loose density of from 3 to 40 pounds per cubic foot, a thermal conductivity K factor of from 0.25 to 0.40 BTU in/hr.° F.ft$^2$ and a fusion point of about 1600° C. to 1700° C. It possesses a somewhat fibrous structure ressembling that of the chrysotile asbestos fibers from which it derives, although this fibrous structure has shown to disappear upon rough manipulation, when subjected to pressure, or when mixed with other material. Then, the fibrous structure is lost but the product has and always retains a high insulating value which is quite superior to granular forsterite or similar to KAOWOOL (trademark) or rockwool.

In the above-mentioned U.S. Pat. application, it is mentioned that FRITMAG may be used as a substitute for asbestos, whenever a fibrous material to be used in bulk and having high insulating qualities is needed. Indeed, FRITMAG is fibrous and has a loose density range substantially identical to asbestos. It also has high insulating properties and is devoided of all the undesirable health problems allegedly attributed to asbestos.

In the above-mentioned U.S. Pat. application, it is also suggested to mix FRITMAG with an inert filler and a binder in order to form an insulating composition adapted to be shooted onto any surface to be insulated or to be moulded in the form of slabs for roof insulation. However, no specific example of such a composition is given, except for a short reference made in the specification to a possible mixing with other materials, such as Portland cement. Similarly, no method of manufacturing slabs from such a composition is disclosed, although it is obvious that some of the methods presently used on an industrial scale to manufacture slabs may not be applicable if FRITMAG is part of the combination, because of the change of structure that has been noticed in this product when it is subjected to pressure or mixed with other materials.

SUMMARY OF THE INVENTION

The present invention derives from further studies that have been conducted on FRITMAG since it was first synthetized.

In accordance with the present invention, it has been found that heat-resistant boards or tubes, capable of resisting to very high temperatures over substantial periods of time can be produced from a new heat-resistant composition comprising from 70 to 95% by weight of FRITMAG, the balance consisting mainly of a binder selected from the group consisting of organic binders, preferably starch or latex; mineral binders of the silicate type, preferably sodium or potassium silicate, and mixtures thereof.

The heat-resistant composition according to the invention may also comprise reinforcing fibers preferably selected from the group consisting of cellulose, glasswool, refractory fibers such as ceramic fibers, rockwool and their mixtures, in such an amount as to give sufficient strength, especially tensile strength, to the composition to make the article produced therefrom operative depending on its intended use.

In accordance with the invention, it has been surprisingly found that the wet spinning method commonly used for manufacturing heat-resistant boards or tubes from a heat-resistant asbestos-containing composition, can also be used with success to manufacture boards or tubes from the heat-resistant composition according to the invention, even if FRITMAG which is known to loose its fibrous structure when pressed or mixed with another material, is used in the starting mixture, in place of asbestos.

The wet spinning method which is used industrially worldwidely and is carried out in machines called after their inventor, Mr. HATSCHEK, basically consists in filtering an aqueous suspension containing from 1 to 15% by weight of solids consisting of asbestos fibers and a binder through a spinning sieve to form a green sheet and recovering on a felt conveyor the green sheet formed on the outer wall of the sieve prior to winding it about a calendering cylinder until the requested thickness is obtained.

To produce a board, the green sheet which is wound onto the calendering cylinder is cut, unwound, shaped and allowed to set.

To produce a tube, the green sheet wound onto the calendering cylinder is allowed to set in place and is slid out of the cylinder.

As indicated hereinabove, the HATSCHEK machine has commonly been used to produce heat-resistant slabs or tubes from a composition containing from 85 to 95% by weight of asbestos, the balance consisting of a binder such as latex or starch, and optionally, inert fillers and/or additives. Over the last decades, numerous studies have been made to find a substitute to this asbestoscontaining composition, which might be processed with the existing high productivity machines of the HATSCHEK type. By way of example, numerous compositions have been proposed, containing substitute fibers such as rockwool, glasswool or fibers of ceramics or of any other refractory material, for use to produce heat-resistant tubes or slabs. Most of the substitute compositions that were so proposed, are effective but very expensive, thereby making their commercial use prohibitive.

In accordance with the invention, it has been found that FRITMAG can effectively be used as a substitute for asbestos to produce boards or tubes in a HATSCHEK machine. More particularly, in accordance with the invention, it has been found that FRITMAG keeps most of the property of asbestos when it is processed in a HATSCHEK machine. Thus, it provides a good homogeneity to suspension; it is easy to filter; it gives homogeneity to the green sheet and it reduces as much as possible the losses of solids with the filtered water. Moreover, it is heat-resistant and gives slabs or tubes that can be subjected to very high temperatures over substantial period of time.

As aforesaid the composition according to the invention may further comprise reinforcing fibers. Advantageously, the amount of reinforcing fibers may be adjusted at will, so as to give sufficient strength, especially tensile strength, to the resulting article to make it operative depending on its intended use. This amount of fibers added to the composition may be very small. Indeed, the addition of such reinforcing fiber is not required by any of the manufacturing methods mentioned hereinabove, but exclusively by the desiderata of the consumer.

Of course, the kind of fibers incorporated into the composition depends on the intended use of the boards or tubes articles produced from the composition.

Similarly, the kind of binders used in the composition depends on the intended use of the resulting product.

If the boards or tubes produced from the composition according to the invention are exclusively intended to be used as fire proofing materials, use is preferably made of an organic binder such as starch or latex. If, however, the product is intended to be used at very high temperatures (up to 1000° C.) while retaining its physical properties, use is preferably made of sodium or potassium silicate as a binder, and of heat-resistant, mineral fibers.

The composition according to the invention may further comprise inert fillers and additives known per se in this very specific field. Examples of such additives are siliceous dust, quartz, crushed stones, kaolin, blast furnace slag, etc.

EXAMPLE 1

Different tests, including comparative tests, were carried out. Each test comprised the production of a sheet, using a wet spinning machine of the HATSCHEK type. manufactured by the Italian company ISPRA. This machine is capable of producing sheets 120 cm long by 40 cm width. The number of rotation of the calendering cylinder was adjusted to obtain a slab having a thickness of 0.5 cm.

Plates of 30 cm×30 cm were cut from the slabs and dried at 105° C. for 12 hours. The resulting plates had a density of about 1.0. Plates of 30 cm×30 cm were also cut from the same sheets and compressed under a pressure of 10MPa prior to being dried at 105° C. for 12 hours. The resulting plates had a density of about 1.3.

The first composition that was processed in the HATSCHEK machine for test purposes comprised the following elements:

| | |
|---|---|
| FRITMAG | 9.0 kg |
| Cellulose | 0.6 kg |
| Starch N (EMPRESOL ®) | 0.5 kg |
| Sodium silicate N | 1.1 kg |

This composition was prepared as follows:

FRITMAG was first added to water in a mixer. Then, cellulose was added to the mixture. The cellulose that was so added was of the Kraft type, defibrated into a PALLMANN defibrator. Cationic starch of trademark EMPRESOL was subsequently added to the mixture. Finally, sodium silicate of grade N (National Silicate) was sprayed with a pneumatic gun onto the green sheet recovered on the felt conveyor of the HATSCHEK machine The mechanical properties of the plate that were obtained with the above composition were compared with those of a commercially available, asbestos-containing MILLBOARD plate (see Table 1) of same size and thickness.

TABLE I

MECHANICAL PROPERTIES AFTER DRYING AT 105° C.

| | Volume weight gr/cm$^3$ | Bending strength MPa | Tensile strength MPa |
|---|---|---|---|
| FRITMAG-containing composition | | | |
| non compressed | 1.04 | 8.4 | 2.1 |
| compressed | 1.30 | 10.5 | 3.5 |
| ASBESTOS-containing composition (MILLBOARD) | 0.90 | 5.6 | 3.0 |

After heating at 800° C. for 5 hours, the MILLBOARD plates made from the asbestos-containing composition commercially available were reduced to dust. After heating at 1000° C. for 8 hours, the plates made from the FRITMAG-containing composition kept from 20 to 30% of their mechanical properties.

EXAMPLE 2

Test plates were produced as disclosed in Example 1, from a heat-resistant composition containing:

| | |
|---|---|
| FRITMAG | 9.0 kg |
| Cellulose | 0.6 kg |
| Glass Fibers | 0.5 kg |
| Starch (EMPRESOL) N | 0.5 kg |
| Sodium Silicate N | 1.1 kg |

The glass fibers that were used in this composition were of the type sold under the trademark FIBERGLASS Canada 6mm 303 wet.

The mechanical properties of the plates that were produced from this composition are given in Table II.

TABLE II

MECHANICAL PROPERTIES AFTER DRYING AT 105° C.

| | Volume weight gr/cm$^3$ | Bending strength MPa | Tensile strength MPa |
|---|---|---|---|
| non compressed | 1.05 | 8.6 | 2.1 |
| compressed | 1.30 | 11.0 | 3.7 |

After heating for 8 hours at 1000° C. the plates produced from the composition given hereinabove kept about 35% of their original mechanical properties.

EXAMPLE 3

Test plates were produced as disclosed in Example 1 from a heat-resistant composition containing:

| | |
|---|---|
| FRITMAG | 9.0 kg |
| Cellulose | 0.6 kg |
| Refractory Fibers | 0.5 kg |
| Starch | 0.5 kg |
| Sodium Silicate N | 1.1 kg |

The fibers used in this composition were of the type sold under the trademark MANVILLE #6.

The mechanical properties of the plates that were produced from this composition are given in Table III.

TABLE III

MECHANICAL PROPERTIES AFTER DRYING AT 105° C.

| | Volume weight gr/cm$^3$ | Bending strength MPa | Tensile strength MPa |
|---|---|---|---|
| non compressed | 1.05 | 8.4 | 2.3 |
| compressed | 1.30 | 11.5 | 3.6 |

After heating for 8 hours at 1000° C., the plates produced from the composition given hereinabove kept about 50% of their original mechanical properties.

What is claimed is:

1. A heat-resistant composition for use in producing articles capable of resisting high temperatures for substantial periods of time, said composition comprising:

(a) from 70 to 95% by weight of a fibrous-like, synthetic forsterite obtained by calcination of chrysotile asbestos fibers at a temperature of from 650° C. to 1450° C., said synthetic forsterite having an MgO: SiO2 ratio lower than 1.1, a raw loose density of from 3 to 40 pcf, a thermal conductivity "k" factor of from 0.25 to 0.40 BTU. in/hr.° F.ft$^2$ and a fusion point of from 1600° C. to 1700° C.; and the binder consisting predominantly of (b) a binder selected from the group consisting of organic binders, mineral binders of the silicate type and mixtures thereof.

2. The composition of claim 1, wherein said organic binders are selected from the group consisting of starch and latex and said mineral binders are selected from the group consisting of sodium silicate and potassium silicate.

3. The composition of claim 2, wherein said binder consists of a mixture of starch and sodium silicate.

4. The composition of claim 1, further comprising reinforcing fibers in such an amount as to give sufficient strength to said composition to make it operative depending on the intended use of the article produced therefrom.

5. The composition of claim 4, wherein said reinforcing fibers are selected from the group consisting of cellulose, glasswool, refractory fibers, rockwool and their mixtures.

6. The composition of claim 2, further comprising reinforcing fibers in such an amount as to give sufficient strength to said composition to make it operative depending on the intended use of the article produced therefrom.

7. The composition of claim 3, further comprising reinforcing fibers in such an amount as to give sufficient strength to said composition to make it operative depending on the intended use of the article produced therefrom.

* * * * *